United States Patent [19]

Properzi

[11] 4,213,321

[45] Jul. 22, 1980

[54] ROLLING METHOD AND ROLLING MILL FOR AN INGOT ORIGINATING FROM A CONTINUOUS CASTING MACHINE OF THE WHEEL-AND-BELT TYPE

[76] Inventor: Giulio Properzi, via Pietro Cossa, 1 Milano, Italy

[21] Appl. No.: 872,216

[22] Filed: Jan. 25, 1978

[30] Foreign Application Priority Data

Mar. 31, 1977 [IT] Italy ..... 21928 A/77

[51] Int. Cl.[2] ..... B21B 1/00

[52] U.S. Cl. ..... 72/235; 72/224

[58] Field of Search ..... 72/234, 235, 224, 225; 164/76, 270

[56] References Cited

U.S. PATENT DOCUMENTS

| | | | |
|---|---|---|---|
| 3,517,537 | 6/1970 | Cofer | 72/234 |
| 3,561,105 | 2/1971 | Cofer | 164/76 X |
| 3,618,354 | 11/1971 | Bindernagel et al. | 72/224 |
| 4,044,586 | 8/1977 | Properzi | 72/224 |

*Primary Examiner*—Milton S. Mehr

*Attorney, Agent, or Firm*—Guido Modiano; Albert Josif

[57] ABSTRACT

There is disclosed a method for rolling an ingot having a substantially trapezoidal cross-section and coming from a continuous casting machine of the wheel-and-belt type, the method comprising initial rolling of the ingot simultaneously on the side corresponding to the minor base of the substantially trapezoidal cross-section and on the edges of the major base of the cross-section to obtain a cross-section having two orthogonal axes of symmetry. The ingot is than rolled by subsequent two-roll stands. There is also disclosed a rolling mill for carrying out the method, comprising a first three-roll stand with the rolls arranged to provide the desired cross-section having two orthogonal axes of symmetry, and with subsequent two-roll stands.

8 Claims, 5 Drawing Figures

ROLLING METHOD AND ROLLING MILL FOR AN INGOT ORIGINATING FROM A CONTINUOUS CASTING MACHINE OF THE WHEEL-AND-BELT TYPE

BACKGROUND OF THE INVENTION

This invention relates to a rolling method and a rolling mill for an ingot originating from a continuous casting machine of the wheel-and-belt type.

The cross-sectional shape and geometry of an ingot leaving a continuous casting machine of the wheel-and-belt type are governed substantially by two factors. In the first place, the ingot has a necessarily flat upper face because of its formation in contact with the metal belt, which, in a casting machine of the said type, closes the mould in the casting wheel over a certain arc, and in the second place it comprises two lateral faces formed in contact with the lateral walls of the casting mould, which must necessarily lie at a certain draft angle to the normal to the upper flat face to enable the ingot to be separated from the casting wheel.

The draft angle, normally 8° to 10°, cannot vary substantially, and thus the only freedom open to the designer in modifying the cross-section of the ingot to any degree in order to better adapt it to the requirements of the rolling to which the ingot will subsequently be subjected, is in the choice of the height/width ratio of the cross-section, and the extent of rounding of the side opposite the flat face, this side reproducing the shape of the base of the casting mould.

In the continuous rolling of these ingots, various methods have been proposed for the first rolling passes in consideration of the particular shape of their cross-section. The most known and widely used methods are those which use several successive rolling stands each with three rolls disposed at 120° to each other to define substantially hexagonal/triangular or round/triangular alternate passes, or several rolling stands each of two rolls with substantially oval/round alternate passes.

In my U.S. Pat. No. 4,044,586 there is proposed a particularly advantageous method for rolling an ingot originating from a continuous casting machine by using three-roll rolling stands disposed directly downstream of the continuous casting machine.

With two-roll stands, and in particular in the case of an oval pass, because of the substantially trapezoidal cross-section of the ingot, there is the drawback of a particularly evident amount of edge outflow of the rolled material, deriving from the compressing of the flat major side of the ingot cross-section during the first rolling pass, with the formation of an excess of material at the edges adjacent to the major side of the cross-section, which project outwards to a marked degree.

This edge outflow is impossible to avoid or even control. Because of the fact that the outflown material again becomes rolled in the second rolling stand, the rolls of which are disposed at 90° to the rolls of the first stand, defects arise known as over-rolling in the case of wire rod. In such a case the projecting edges become bent back on themselves and compressed during the second pass, but without becoming integrated with the underlying material, neither in that pass nor in the subsequent passes. This over-rolling defect leads to frequent wire breakage when the rod is drawn to a diameter of less than 0.5 mm.

As the amount of outflow at the upper edges of the ingot after the first rolling pass is proportional to the increase in the percentage reduction of the cross-section during the said rolling pass, it is not possible to utilize the first rolling pass to the maximum extent which could be supported by the type of metal being rolled.

SUMMARY OF THE INVENTION

The object of the present invention is to overcome said drawbacks and difficulties by providing a rolling method and a rolling mill which enable an ingot of substantially trapezoidal cross-section originating from a continuous casting machine of the wheel-and-belt type to be rolled without the appearance of over-rolling, even though using a rolling provided with stands comprising two opposing rolls disposed alternately at 90° to each other.

This object is attained according to the invention by a method for rolling an ingot originating from a continuous casting machine of the wheel-and-belt type and having a substantially trapezoidal cross-section wherein, before being rolled by rolling stands comprising two rolls alternately arranged at 90° to each other, the ingot of substantially trapezoidal cross-section is first rolled simultaneously on the side corresponding to the minor base of the substantially trapezoidal cross-section and on the edges of the major base of the substantially trapezoidal cross-section by three rolls having flat profiles arranged to form a rough-rolled product with a cross-section having two orthogonal axes of symmetry.

With a method of this type it is possible to eliminate edge outflow and the consequent over-rolling, as the rolling of the edges eliminates the acute angles of the rolled cross-section, which are mainly responsible for the formation of the edge outflow, and in addition the regularity of the rolled cross-section obtained ensures best conditions for rolling by the subsequent stands comprising two rolls alternately rotated through 90°.

For carrying out the method according to the invention, a rolling mill is proposed comprising rolling stands having two rolls alternately arranged at 90° to each other and defining a substantially oval and/or circular pass, and further comprising upstream of said rolling stands a first rolling stand comprising three rolls disposed relative to the rolling axis in such a manner as to roll the ingot of substantially trapezoidal cross-section on that side defining the minor base of the substantially trapezoidal cross-section and on the opposite edges to obtain a rough-rolled product with a cross-section having two orthogonal axes of symmetry.

BRIEF DESCRIPTION OF THE DRAWING

Further characteristics and advantages of the invention will be more evident from the description given hereinafter of some preferred embodiments of the invention, with reference to the accompanying drawing in which.

DESCRIPTION OF THE PREFERRED EMBODIMENTS

Figure 1:
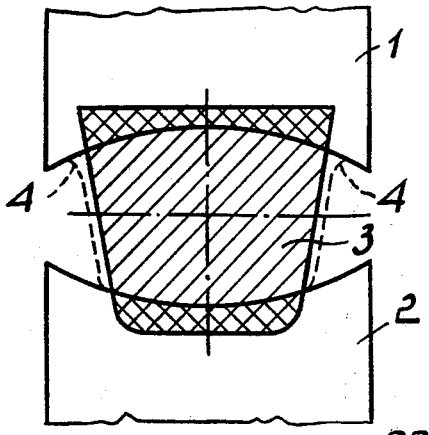
Fig. 1 PRIOR ART
FIGS. 1 and 2 are each a diagrammatic representations of a two-roll rolling stand of a rolling mill of known type, the two rolls defining an oval pass.

With reference firstly to FIG. 1, the reference numerals 1 and 2 indicate two rolls of a first rolling stand of a rolling mill of known type, the two rolls having horizontal axes and defining an oval pass. As can be seen from the figure, the ingot 3, of substantially trapezoidal cross-section, undergoes deformation during rolling between the rolls 1 and 2 as indicated by the dashed lines, and widens in a direction parallel to the axes of the rolls 1 and 2, to undergo edge outflow at the edges of the side corresponding to the major base of the cross-section. During the next pass between rolls disposed at 90° to those indicated in FIG. 1, this edge outflow is bent back in itself under the action of the rolls, resulting in over-rolling which is damaging for the final drawing due to the fact that the part bent back does not integrate with the adjacent underlying material.

Figure 2:
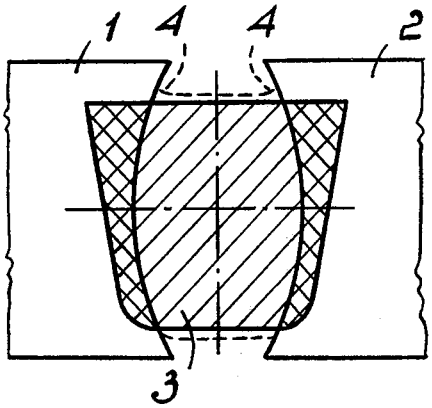

The same phenomenon occurs when an ingot of substantially trapezoidal cross-section is rolled with a first stand comprising rolls disposed with their axes vertical as indicated in FIG. 2. A more or less accentuated edge outflow 4 forms at the edges adjacent to the major base of the trapezoidal cross-section, to give rise to more or less evident over-rolling in the subsequent passes.

In contrast, the invention proposes to roll the ingot in such a manner as to obtain a rough-rolled product with a cross-section having two orthogonal axes of symmetry, before rolling the ingot by two-roll stands of the type heretofore described.

Figure 3:
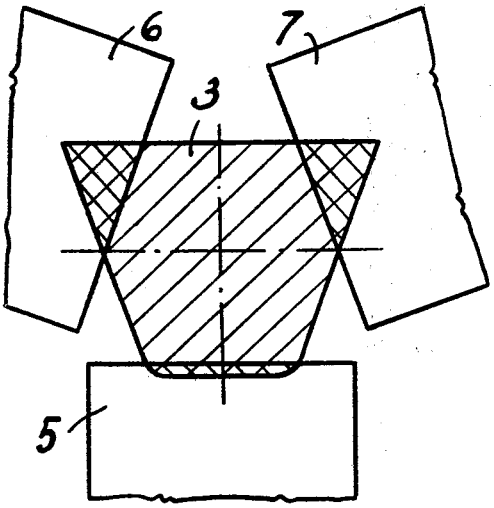
FIG. 3 is a diagrammatic representation of a rolling stand according to the invention.
Figure 4:
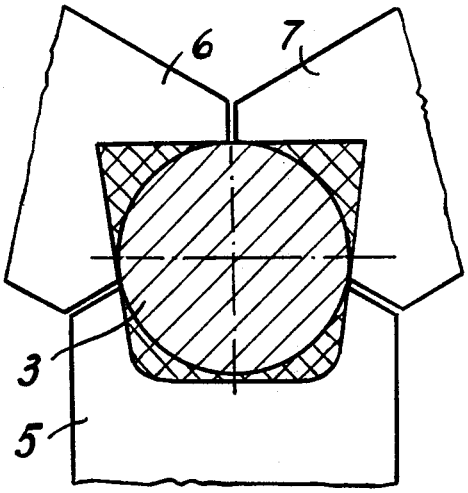
FIG. 4 is a diagrammatic representation of a further rolling stand according to the invention.

For this purpose, as shown in FIGS. 3 and 4, a stand is used comprising three rolls 5, 6 and 7 disposed relative to the rolling axis in such a manner as to roll the base of the ingot 3, corresponding to the minor base of the substantially trapezoidal cross-section of the ingot, and the edges opposite the minor base, so as to give rise to an ingot having a cross-section with two orthogonal axes of symmetry. Advantageously the two rolls 6 and 7 are disposed at 100°–140° to the roll 5.

In the case shown in FIG. 3, in which the rolls have profiles which define a substantially triangular pass, an ingot of hexagonal cross-section is obtained. In the case shown in FIG. 4, in which the rolls have profiles defining a circular pass, an ingot of circular cross-section is obtained.

As can be seen from FIGS. 3 and 4, with the first pass as heretofore described it is advantageously possible to obtain a relatively small reduction in cross-section of less than 20%, and preferably of 10 to 20%, to obtain the described hexagonal or circular rough-rolled product. It is thus possible to use a stand which is of relatively light construction and thus inexpensive. The described addition of a three-roll stand to a rolling mill comprising two-roll stands is therefore not an excessively costly solution, a further reason being that because the three-roll stand only slightly reduces the cross-section of the ingot, it requires a power which is considerably less than that required by the first stand in conventional rolling mills, and enables the subsequent two-roll stands to be better utilized because of the form of the rough-rolled product produced, so that they can provide reductions in oval cross-section of 40 to 50%.

Figure 5:
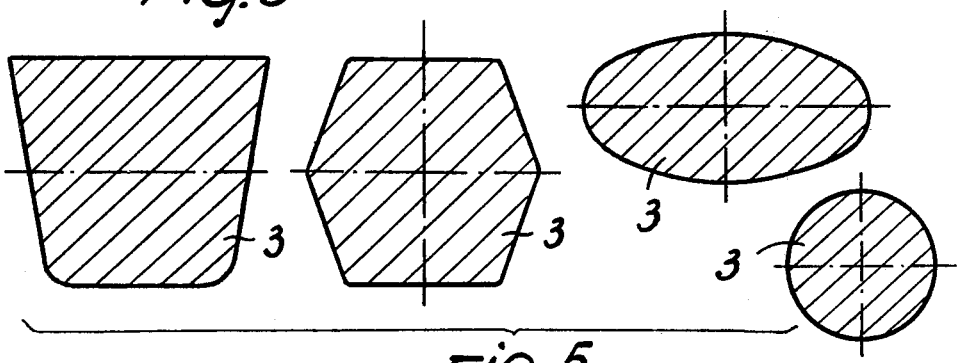
FIG. 5 is an example of successive passes in a rolling mill according to the invention.

FIG. 5 shows one possible series of passes starting from an ingot of substantially trapezoidal cross-section and using the stand indicated in FIG. 3 as the first rolling stand, followed by one stand with an oval passage and one with a circular passage. Instead of the first pass shown in the diagram of FIG. 3, it is obviously possible to provide a first pass of the type shown in the diagram of FIG. 4, which represents a special case of FIG. 3. However, for a first circular pass it is preferable to start with trapezoidal ingots having a particular height/width ratio, for example as shown in FIG. 4. It is not necessary for all stands subsequent to the first to be of the two-roll type, and instead there could for example be at least one second and one third two-roll stand followed by one or more three-roll stands to roll the product to the final required diameter.

The described invention can obviously be widely varied within the scope of the appended claims.

I claim:

1. A rolling method for an ingot originating from a continuous casting machine of the wheel-and-belt type, and having a substantially trapezoidal cross-section, wherein before being rolled by rolling stands comprising two rolls alternately arranged at 90° to each other, the ingot of substantially trapezoidal cross-section is first rolled simultaneously on the side corresponding to the minor base of the substantially trapezoidal cross-section and on the edges of the major base of the substantially trapezoidal cross-section by three rolls having flat profiles arranged to form a rough-rolled product with a cross-section having two orthogonal axes of symmetry.

2. A method as claimed in claim 1, wherein the ingot is rolled into a hexagonal form during the first rolling pass.

3. A method as claimed in claim 1, wherein the ingot is rolled into a circular form during the first rolling pass.

4. A method as claimed in claim 1, wherein during the first rolling pass the cross-section of the ingot is reduced by an amount less than 20%.

5. A method as claimed in claim 2, wherein the ingot is rolled into an oval and circular form in the rolling stands following the first rolling stand.

6. A method as claimed in claim 2, wherein the ingot is rolled into a circular form in the rolling stand following the first rolling stand.

7. A method as claimed in claim 3, wherein the ingot is rolled into an oval form in the rolling stand following the first rolling stand.

8. A rolling mill for an ingot originating from a continuous casting machine of the wheel-and-belt type and having a substantially trapezoidal cross-section, comprising rolling stands having two rolls alternately arranged at 90° to each other and defining a substantially oval and/or circular pass, and further comprising upstream of said rolling stands a first rolling stand comprising three rolls having flat profiles and being disposed relative to the rolling axis in such a manner as to roll the ingot of substantially trapezoidal cross-section on that side defining the minor base of the substantially trapezoidal cross-section and on the opposite edges, to obtain a rough-rolled product with a cross-section having two orthogonal axes of symmetry.

* * * * *